United States Patent [19]

Klug

[11] 4,005,381

[45] Jan. 25, 1977

[54] SLIDE POTENTIOMETER

[75] Inventor: Robert F. Klug, Hemet, Calif.

[73] Assignee: Dale Electronics, Inc., Columbus, Nebr.

[22] Filed: June 9, 1975

[21] Appl. No.: 585,092

[52] U.S. Cl. ..... 338/119; 338/128; 338/183; 338/196

[51] Int. Cl.[2] ..... H01C 10/00

[58] Field of Search ..... 338/118, 119, 128, 183, 338/184, 196, 307

[56] References Cited

UNITED STATES PATENTS

| | | | |
|---|---|---|---|
| 2,242,327 | 5/1941 | Rubinstein | 338/183 |
| 3,588,779 | 6/1971 | Goerg | 338/183 |
| 3,617,976 | 11/1971 | Campbell | 338/183 X |
| 3,643,129 | 9/1972 | Shimibu | 338/183 |
| 3,909,770 | 9/1975 | Oka et al. | 338/119 |

*Primary Examiner*—C. L. Albritton
*Attorney, Agent, or Firm*—Zarley, McKee, Thomte & Voorhees

[57] ABSTRACT

A slide potentiometer comprising a housing having a printed circuit board positioned in an interior compartment formed therein. An elongated resistance element is provided on one side of the circuit board and has a pair of terminals electrically connected to the opposite ends thereof. An elongated collector element is positioned on the one side of the circuit board in a parallel spaced apart relationship to the resistance element. A third terminal is electrically connected to the collector element. A wiper block is slidably mounted in the interior compartment of the housing and has a pair of electrically connected wiper elements which slidably electrically contact the resistance element and the collector element. The wiper block is provided with an actuator element which extends upwardly therefrom. A cover is secured to the housing and extends over the upper end thereof and has an elongated slot formed therein which receives the actuator element extending therethrough. A knob or the like is secured to the upper end of the actuator element to permit the wiper block to be selectively slidably moved relative to the resistance element and the collector element. A modified form of the potentiometer is also disclosed wherein a second wiper block is slidably mounted in the interior compartment of the housing on the opposite side of the circuit board and which is in electrical contact with a second resistance element and a second collector element provided on the other side of the circuit board. Each of the embodiments includes means for maintaining the wiper blocks in electrical engagement with the resistance element and the collector element.

9 Claims, 6 Drawing Figures

SLIDE POTENTIOMETER

BACKGROUND OF THE INVENTION

This invention relates to a slide potentiometer and more particularly to an improved slide potentiometer.

Slide potentiometers are common in the potentiometer art but the slide potentiometers presently available normally have an excessive number of component parts and the assembly of the same is time consuming and expensive.

Therefore, it is a principal object of the invention to provide a slide potentiometer which has a reduced number of component parts when compared to the conventional slide potentiometers.

A further object of the invention is to provide a slide potentiometer which may be either of the single or double element configuration.

A further object of the invention is to provide a slide potentiometer including means for maintaining the wiper block in electrical contact with the resistance and collector elements.

A further object of the invention is to provide a slide potentiometer including means thereon which provides a visual indication of the relative position of the wiper block.

A further object of the invention is to provide a slide potentiometer which is easy to assembly.

A further object of the invention is to provide a slide potentiometer which is economical of manufacture, durable in use and refined in appearance.

These and other objects will be apparent to those skilled in the art.

BRIEF DESCRIPTION OF THE DRAWINGS

This invention consists in the construction, arrangements and combinations of the various parts of the device, whereby the objects contemplated are attained as hereinafter more fully set forth, specifically pointed out in the claims, and illustrated in the accompanying drawings, in which:

DESCRIPTION OF THE PREFERRED EMBODIMENT

Figure 5:
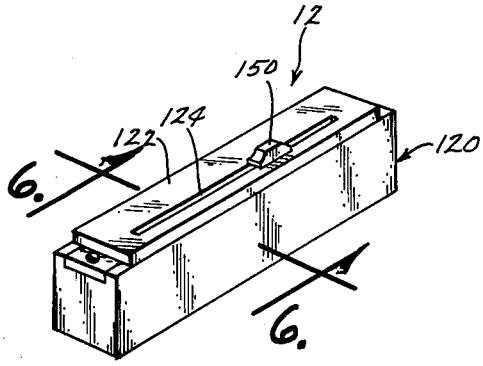
FIG. 5 is a perspective view of the single element slide potentiometer of this invention.
Figure 6:
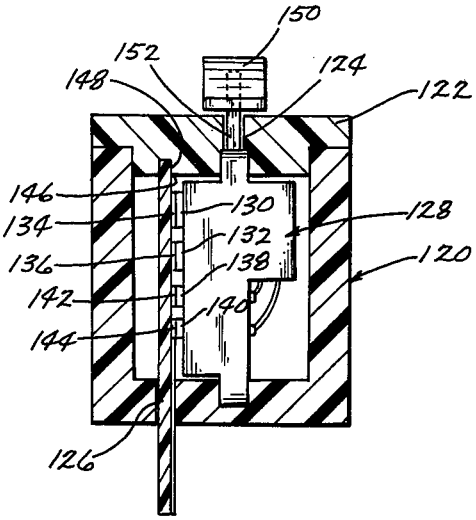
FIG. 6 is a sectional view as seen on lines 6 — 6 of FIG. 5.

In FIGS. 1 – 4, the numeral 10 refers generally to a slide potentiometer of the double element type while the numeral 12 in FIGS. 5 and 6 refers to the single element slide potentiometer of this invention. Potentiometer 10 generally comprises a housing 14 comprised of a suitable insulative material well known to the industry. For purposes of description only, housing 14 will be described as having a bottom 16, opposite sides 18 and 20, opposite ends 22 and 24 and an open upper end 26. It should be understood that the potentiometer of this invention may be positioned in any attitude but the housing is described in the foregoing language merely for ease of description.

Figure 1:
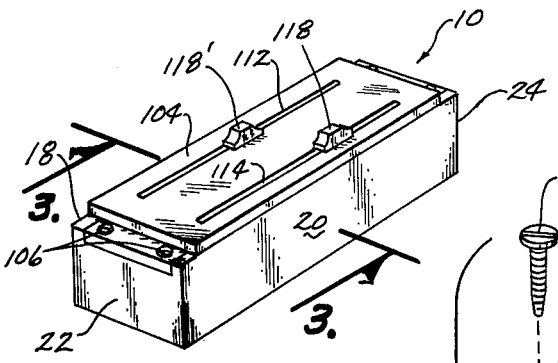
FIG. 1 is a perspective view of the slide potentiometer of this invention.
Figure 2:
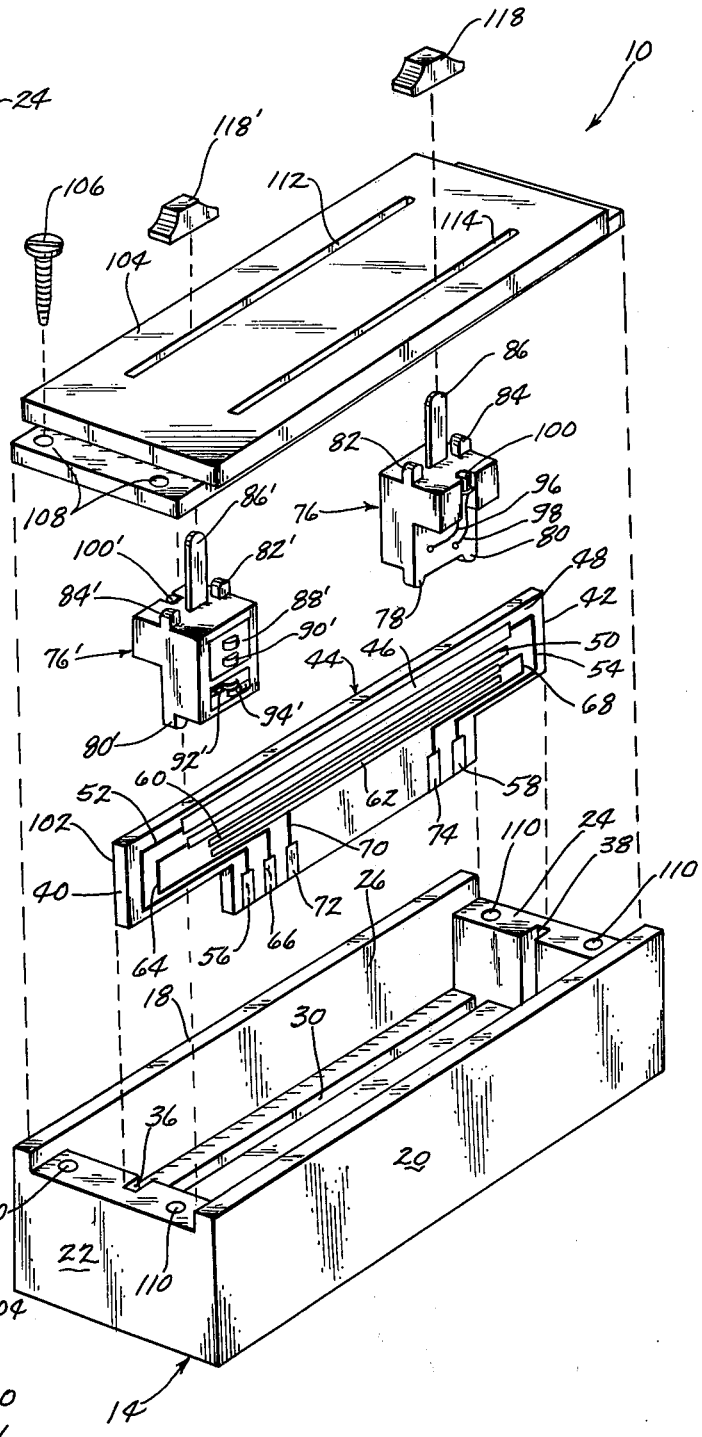
FIG. 2 is an exploded perspective view of the potentiometer of FIG. 1.
Figure 3:
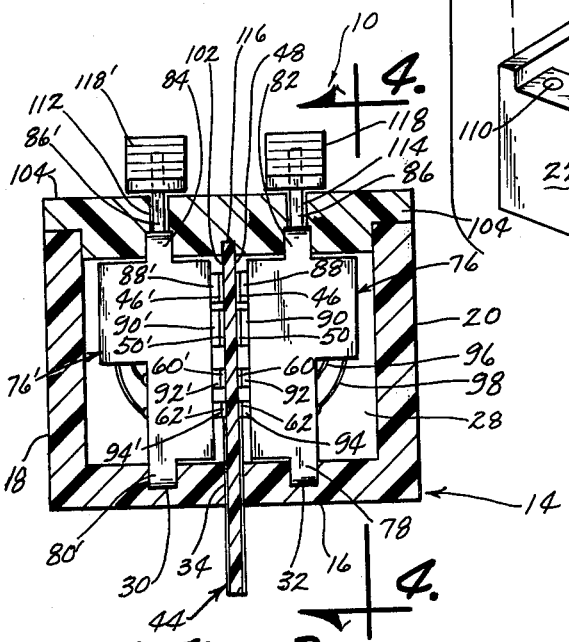
FIG. 3 is an enlarged sectional view as seen on lines 3 — 3 of FIG. 1.
Figure 4:
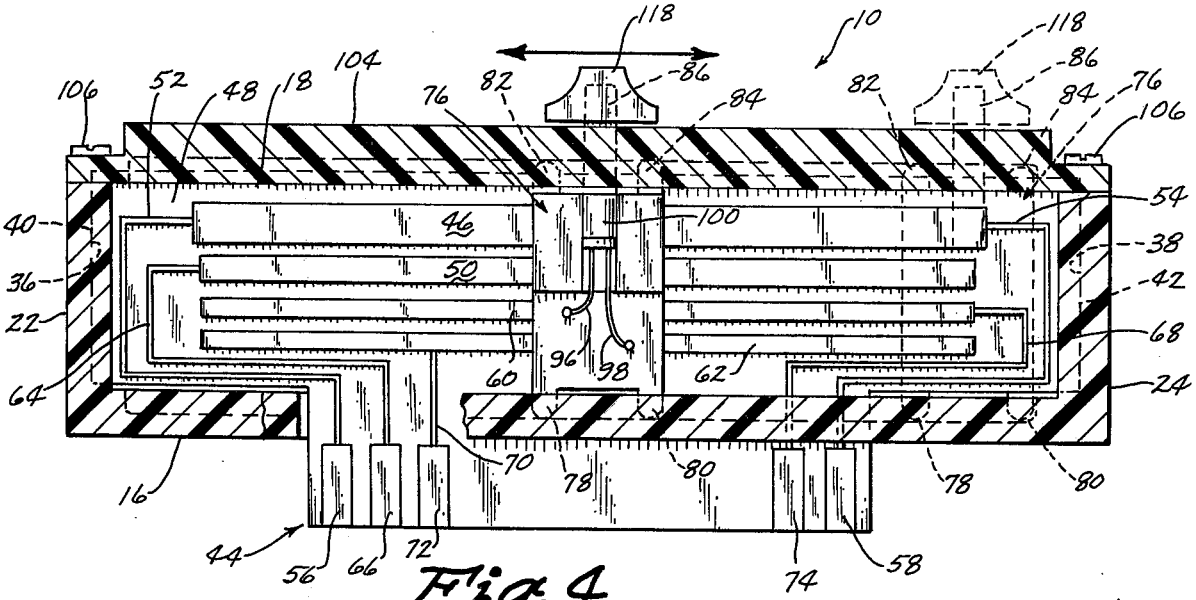
FIG. 4 is a sectional view seen on lines 4 — 4 of FIG. 3.

Housing 14 is provided with an interior compartment 28 formed therein which communicates with the upper end 26. A pair of elongated grooves, slots or channels 30 and 32 are formed in the upper surface of bottom 16 as illustrated in FIG. 3 for a purpose to be described hereinafter. An elongated opening or slot 34 is also formed in the bottom 16 as will be described in more detail hereinafter. Ends 22 and 24 of housing 14 are provided with vertically disposed channels 36 and 38 formed therein which are adapted to receive the opposite ends 40 and 42 respectively of a flat support member 44. The numeral 46 refers to an elongated resistance element which is positioned on side 48 of member 44 while the numeral 50 refers to an elongated collector element which is positioned on side 48 in a parallel and spaced relationship to the resistance element 46. Terminals 52 and 54 are electrically connected to the opposite ends of resistance element 46 and terminate in pad portions 56 and 58 respectively which are positioned adjacent the lower end of the member 44. Spaced apart conductor elements 60 and 62 are provided on side 48 of member 44 in a parallel and spaced apart relationship to the resistance element 46 and the collector element 50 as illustrated in FIG. 2. Terminal 64 is electrically connected to one end of the collector element 50 and terminates in a pad portion 66 adjacent the lower end of member 44. Terminals 68 and 70 are electrically connected to conductor elements 60 and 62 respectively and terminate in pad portions 72 and 74 adjacent the lower end of member 44. As seen in the drawings, the member 44 is inserted downwardly into the interior compartment of the housing so that the ends 40 and 42 are received by the channels 36 and 38 and so that the lower end of the member 44 extends downwardly through the opening 34 formed in bottom 16.

The numeral 76 refers generally to a wiper block comprised of an electrical insulative material well known to the industry. Wiper block 76 includes a pair of guide lugs 78 and 80 which extend downwardly therefrom and which are received by the channel 32. Wiper block 76 also includes a pair of upwardly extending guide lugs 82 and 84. An actuator lever 86 extends upwardly from wiper block 76 and is preferably unitarily constructed with the wiper block 76. Wiper block 76 is provided with a pair of electrically connected wiper elements 88 and 90 which are adapted to slidably contact resistance element 46 and collector element 50 respectively. The numerals 92 and 94 refer to spring contacts or wiper elements which are adapted to slidably engage the conductor elements 60 and 62 respectively. Leads 96 and 98 are electrically connected to the wiper elements 92 and 94 respectively and extend to a light means 100 mounted on the wiper block 76 as illustrated in FIG. 2 preferably adapted to direct light upwardly. Preferably, the light means 100 is a light emitting diode.

In the potentiometer 10, the member 44 is provided with a resistance element, collector element, conductors and associated terminals on side 102 which is opposite to side 48. Likewise, a wiper block 76' is also provided which is adapted to wipe upon the resistance element, collector element, and conductors provided on side 102 in a manner identical to that just described. Inasmuch as the structure on side 102 and the wiper block associated therewith is identical to that just described, identical structure will be referred to with "'".

A cover or panel 104 is secured to the housing 14 by means of screws 106 extending through openings 108 and being threadably received by the openings 110 in ends 22 and 24. Cover 104 is provided with a pair of elongated slots 112 and 114 extending therethrough adapted to receive the actuators 86' and 86 respectively. As illustrated in FIG. 3, the lower ends of the slots 112 and 114 are enlarged to receive the upwardly extending guide lugs on the upper ends of the wiper blocks. As also illustrated in FIG. 3, the underside of cover 104 is provided with an elongated channel 116 which is adapted to receive the upper end of the member 44. Knobs 118 and 118' are secured to the upper ends of actuators 86 and 86' by any convenient means by heat staking or ultrasonic welding.

Assuming that the potentiometer 10 is in its unassembled state, the member 44 is inserted downwardly into the interior compartment of the housing 14 so that its ends 40 and 42 are received by the channels 36 and 38 respectively and so that the lower end of the member 44 extends downwardly through the opening 34. While it is preferred that the lower end of the member 44 extends downwardly from the housing, it should be noted that the lower end of the member 44 could terminate at some point above the lower end of the housing and adapted to receive prongs or plugs inserted upwardly into the opening 36.

The wiper blocks 76 and 76' are then inserted downwardly into the interior compartment of the housing so that the guide lugs on the lower ends thereof are received by the channels 30 and 32. Cover 104 is then secured to the housing so that the actuators 86 and 86' extend upwardly through the slots 114 and 112 respectively and so that the guide lugs on the upper ends of the wiper blocks are received by the lower ends of the slots 112 and 114 and so that the upper end of the member 44 is received by the channel 116. Screws 106 are then installed and the knobs 118 and 118' mounted on the actuators 86 and 86'.

The fact that the guide lugs on the wiper blocks are received by guide channels insures that the wiper blocks will be maintained in position relative to the member 44 so that the wiper elements will be maintained in positive electrical contact with the respective elements. The potentiometer 10 may then be installed in the necessary circuit by electrically connecting the pad portions 56, 66 and 58 in conventional fashion with the pad portions on the opposite side of the member 44 also being connected to the desired circuit. The board may be directly attach to either a solderless quick disconnect or directly inserted into a printed circuit connector. The pad portions 72 and 74 are also suitably electrically connected to a source of electrical energy so that the light emitting diode 100 will be illuminated. The illumination of the light means 100 causes light to be directed upwardly through the translucent cover 104 so that the position of the wiper block 76 is indicated relative to the resistance element and collector element. In other words, the potentiometer 10 could be operated in dark locations since the light means 100 would provide a visual means of determining the position of the wiper block. It should be noted that the light means 100 is an optional feature and is not necessary for the slide potentiometer 10 to function.

The slide potentiometer 12 illustrated in FIGS. 5 and 6 is identical to the slide potentiometer 10 except that it is of the single element type. In other words, only a single wiper block is provided and only one side of the member 44 is provided with resistance and collector elements and conductor elements. Generally speaking, the potentiometer 12 comprises a housing 120 having a cover 122 secured thereto which has a single elongated slot 124 formed therein. Support member 126 is mounted in the interior compartment of the housing 120 and has its lower end extending downwardly through an opening formed in the bottom of the housing. Wiper block 128 is slidably mounted in the housing and has electrically connected wipers 130 and 132 in slidable engagement with resistance element 134 and collector element 136 respectively. Wiper block 128 is also provided with wiper elements 138 and 140 which are in slidable electrical contact with the conductors 142 and 144. Resistance element 134, collector element 136 and conductors 142 and 144 are positioned on side 146 of member 126. The wiper block 128 has upwardly and downwardly projecting guide lugs for maintaining the wiper block in the proper position relative to the member 44. As illustrated in FIG. 6, cover 122 is provided with an elongated channel 148 which is adapted to receive the upper end of the member 126 to maintain the member 126 in position. Knob 150 is secured to the upper end of actuator elements 152 which extends upwardly from the wiper block 128. The operation of the potentiometer 12 is identical to the operation of potentiometer 10 which has been previously described and which will not be repeated herein for purposes of conciseness.

Thus it can be seen that a novel slide potentiometer has been provided which is easily assembled and which involves a reduced number of component parts compared to the previous slide potentiometers. It is preferred that the number 44 and the resistance element, collector element, conductors, etc. are of the printed circuit type but other methods of providing resistance and collector elements on a support member may be employed. The member 44 permits the device to either be directly attachable to a solderless quick disconnect or directly insertable into a printed circuit connector. The wiper block and the actuator are of one piece molded construction which reduces assembly steps and costs. The "fall together" or "drop-in" assembly permits the potentiometer to be quickly and cheaply assembled. Thus it can be seen that the potentiometer accomplishes at least all of its stated objective.

I claim:

1. A slide potentiometer comprising, an elongated housing having opposite ends, a bottom, an interior compartment and an open upper end communicating with said interior compartment, a flat support member positioned in said interior compartment and having opposite sides and opposite ends, an elongated resistance means on one side of said flat support member, an elongated collector means on said one side of said flat support member parallel to and spaced from said resistance means, first and second terminals electrically connected to the opposite ends of said resistance means, a third terminal electrically connected to said collector means, a wiper block slidably mounted in said interior compartment and having first and second electrically connected wiper elements in slidable electrical contact with said resistance means and said collector means respectively, said wiper block having an actuator member extending upwardly therefrom, a cover means secured to said housing upper end and having an elongated slot formed therein which receives said actuator member extending therethrough, and means for maintaining said wiper elements in electrical contact with said resistance means and said collector means respectively, said housing bottom having an elongated slot formed therein, said flat support member having a lower end portion extending downwardly through said elongated slot.

2. A slide potentiometer comprising, an elongated housing having opposite ends, a bottom, an interior compartment and an open upper end communicating with said interior compartment, a flat support member positioned in said interior compartment and having opposite sides and opposite ends, an elongated resistance means on one side of said flat support member, an elongated collector means on said one side of said flat support member parallel to and spaced from said resistance means, first and second terminals electrically connected to the opposite ends of said resistance means, a third terminal electrically connected to said collector means, a wiper block slidably mounted in said interior compartment and having first and second electrically connected wiper elements in slidable electrical contact with said resistance means and said collector means respectively, said wiper block having an actuator member extending upwardly therefrom, a cover means secured to said housing upper end and having an elongated slot formed therein which receives said actuator member extending therethrough, and means for maintaining said wiper elements in electrical contact with said resistance means and said collector means respectively, each of said opposite ends of said housing having a groove formed therein for receiving the opposite ends of said flat support member.

3. A slide potentiometer comprising, an elongated housing having opposite ends, a bottom, an interior compartment and an open upper end communicating with said interior compartment, a flat support member positioned in said interior compartment and having opposite sides and opposite ends, an elongated resistance means on one side of said flat support member, an elongated collector means on said one side of said flat support member parallel to and spaced from said resistance means, first and second terminals electrically connected to the opposite ends of said resistance means, a third terminal electrically connected to said collector means, a wiper block slidably mounted in said interior compartment and having first and second electrically connected wiper elements in slidable electrical contact with said resistance means and said collector means respectively, said wiper block having an actuator member extending upwardly therefrom, a cover means secured to said housing upper end and having an elongated slot formed therein which receives said actuator member extending therethrough, and means for maintaining said wiper elements in electrical contact with said resistance means and said collector means respectively, said means for maintaining said wiper elements in electrical contact with said resistance means and said collector means comprising longitudinally extending grooves formed in said housing bottom and the bottom surface of said cover, said wiper block having guide lugs extending therefrom which are slidably received by said grooves.

4. A slide potentiometer comprising, an elongated housing having opposite ends, a bottom, an interior compartment and an open upper end communicating with said interior compartment, a flat support member positioned in said interior compartment and having opposite sides and opposite ends, an elongated resistance means on one side of said flat support member, an elongated collector means on said one side of said flat support member parallel to and spaced from said resistance means, first and second terminals electrically connected to the opposite ends of said resistance means, a third terminal electrically connected to said collector means, a wiper block slidably mounted in said interior compartment and having first and second electrically connected wiper elements in slidable electrical contact with said resistance means and said collector means respectively, said wiper block having an actuator member extending upwardly therefrom, a cover means secured to said housing upper end and having an elongated slot formed therein which receives said actuator member extending therethrough, and means for maintaining said wiper elements in electrical contact with said resistance means and said collector means respectively, said cover having an elongated groove formed in the bottom surface thereof which receives the upper end of said flat support member.

5. A slide potentiometer comprising, an elongated housing having opposite ends, a bottom, an interior compartment and an open upper end communicating with said interior compartment, a flat support member positioned in said interior compartment and having opposite sides and opposite ends, an elongated resistance means on one side of said flat support member, an elongated collector means on said one side of said flat support member parallel to and spaced from said resistance means, first and second terminals electrically connected to the opposite ends of said resistance means, a third terminal electrically connected to said collector means, a wiper block slidably mounted in said interior compartment and having first and second electrically connected wiper elements in slidable electrical contact with said resistance means and said collector means respectively, said wiper block having an actuator member extending upwardly therefrom, a cover means secured to said housing upper end and having an elongated slot formed therein which receives said actuator member extending therethrough, and means for maintaining said wiper elements in electrical contact with said resistance means and said collector means respectively, a second resistance means and a second collector means being positioned on the other side of said flat support member, said second resistance means having a pair of terminals electrically connected to the opposite ends thereof, said second collector means having a terminal electrically connected thereto, a second wiper block slidably mounted on said interior compartment and having a pair of electrically connected wiper elements thereon which are in slidable electrical contact with said second resistance means and said second collector means respectively, said second wiper block having an actuator member extending upwardly therefrom through a second elongated slot formed in said cover means.

6. The slide potentiometer of claim 1 wherein said first, second and third terminals are mounted on said lower end portion of said flat support member.

7. The slide potentiometer of claim 1 wherein said first, second and third terminals terminate at said lower end portion of said flat support member to permit the electrical connection of the same to an electrical circuit.

8. The slide potentiometer of claim 7 wherein said flat support member is comprised of an electrically insulative material, said resistance means, said collector means and said first, second and third terminals being printed on said flat support member.

9. The slide potentiometer of claim 1 wherein spaced apart first and second elongated conductor elements are positioned on said one side of said flat support member parallel to and spaced from said resistance means and said collector means, fourth and fifth terminals electrically connected to said first and second conductor elements respectively and adapted to be electrically connected to a source of electrical energy, said wiper block having spaced apart third and fourth wiper elements thereon in slidable electrical contact with said first and second conductor elements respectively and a light means electrically connected to said third and fourth wiper elements adapted to visually indicated the position of said wiper block relative to said housing.

* * * * *